US007231673B1

(12) United States Patent
Arnold et al.

(10) Patent No.: US 7,231,673 B1
(45) Date of Patent: Jun. 19, 2007

(54) PORTABLE SHOWER STALL

(75) Inventors: Larry Arnold, San Leandro, CA (US); Rosemary Arnold, San Leandro, CA (US)

(73) Assignee: Care Giver Support Products, LLC, San Leandro, CA (US)

( * ) Notice: Subject to any disclaimer, the term of this patent is extended or adjusted under 35 U.S.C. 154(b) by 304 days.

(21) Appl. No.: 10/951,365

(22) Filed: Sep. 28, 2004

(51) Int. Cl.
*A47K 3/022* (2006.01)

(52) U.S. Cl. ..... 4/599; 4/604; 135/144; 135/156

(58) Field of Classification Search ..... 4/527, 4/585, 587, 599, 600, 602, 603, 604, 608, 4/610, 616, 617, 900; 135/144, 156
See application file for complete search history.

(56) References Cited

U.S. PATENT DOCUMENTS 314,752 A * 3/1885 Throckmorton ..... 4/587
568,808 A * 10/1896 Wyckoff ..... 4/527 X
1,495,413 A * 5/1924 Hopponen ..... 4/600
2,065,226 A * 12/1936 Kennedy ..... 4/587 X
2,134,879 A * 11/1938 Levy ..... 135/156 X
3,600,720 A 8/1971 Marschall ..... 4/599
4,453,280 A 6/1984 Greenleaf ..... 4/599
4,757,561 A * 7/1988 Crump ..... 40/604
5,007,118 A 4/1991 Ebersole ..... 4/515
6,370,713 B2 4/2002 Bosio ..... 4/677
6,463,599 B1 10/2002 Perthu ..... 4/599

* cited by examiner

*Primary Examiner*—Robert M. Fetsuga
(74) *Attorney, Agent, or Firm*—Goldstein Law Offices, P.C.

(57) ABSTRACT

A portable shower stall, for allowing a person to bathe while seated in a wheelchair, for temporary installation in a kitchen having a sink having a basin and a hand sprayer. The shower stall has a frame having side panels and a rear panel that are selectively foldable, a top rail and a lower rail. A base tray extends below the frame and collects waste water. A curtain extends downwardly from the top rail and directs waste water into the base tray. The base tray has a front flap that selectively lowers to allow the person to roll the wheelchair into the base tray between the side walls and rear wall to bathe using the hand sprayer, while a pump returns waste water from the base tray to the basin.

5 Claims, 4 Drawing Sheets

PORTABLE SHOWER STALL

BACKGROUND OF THE INVENTION

The invention relates to a portable shower stall. More particularly, the invention relates to a device that allows a person to shower while seated in a wheelchair in a room that has a sink, such as a kitchen.

When a person suffers from an injury and disability that prevents them from standing, they cannot use a conventional shower. Bathing, however, remains quite important not only to the person's health, but for them to maintain self-esteem and dignity.

A common solution is to position a bathing chair within the shower for the person to sit upon. Unfortunately, the use of a bathing chair requires the caregiver to transfer the person to the bathing chair. It is very common, however, for the person to become injured while being transferred to the bathing chair.

U.S. Pat. No. 4,453,280 to Greenleaf, U.S. Pat. No. 4,975,992 to Patterson et al., and U.S. Pat. No. 6,463,599 to Perthu all disclose portable showers. Unfortunately, none of these devices would be suitable for use by a person seated in a wheelchair.

U.S. Pat. No. 5,007,118 to Ebersole discloses a head care station, for shampooing the hair of a person seated in a wheelchair. U.S. Pat. No. 3,600,720 to Marschall discloses a combination sink and shower unit. Neither of these devices provide an effective solution for bathing a person in a wheelchair.

While these units may be suitable for the particular purpose employed, or for general use, they would not be as suitable for the purposes of the present invention as disclosed hereafter.

SUMMARY OF THE INVENTION

It is an object of the invention to provide a portable shower stall that effectively allows a person to shower while seated in a wheelchair. Accordingly, the shower stall has a front wall that drops down to floor level so that the wheelchair can roll into the shower stall and then raises to effectively catch water while the person showers within the stall.

It is another object of the invention to provide a portable shower stall that can be used in any kitchen having a sink with a hand sprayer. Accordingly, the shower stall is easily deployed on the kitchen floor adjacent to the sink, has a pickup tube and pump for removing water from the stall base tray to the sink drain, and thereby permits the hand sprayer to be used to shower the person in the wheelchair.

It is yet another object of the invention to provide a portable shower stall that folds compactly for storage. Accordingly, the shower stall includes a rigid frame that supports a vertical curtain and a flexible plastic base tray. When not in use, the frame is folded substantially flat and the tray is rolled up for storage.

The invention is a portable shower stall, for allowing a person to bathe while seated in a wheelchair, for temporary installation in a kitchen having a sink having a basin and a hand sprayer. The shower stall has a frame having side panels and a rear panel that are selectively foldable, a top rail and a lower rail. A base tray extends below the frame and collects waste water. A curtain extends downwardly from the top rail and directs waste water into the base tray. The base tray has a front flap that selectively lowers to allow the person to roll the wheelchair into the base tray between the side walls and rear wall to bathe using the hand sprayer, while a pump returns waste water from the base tray to the basin.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
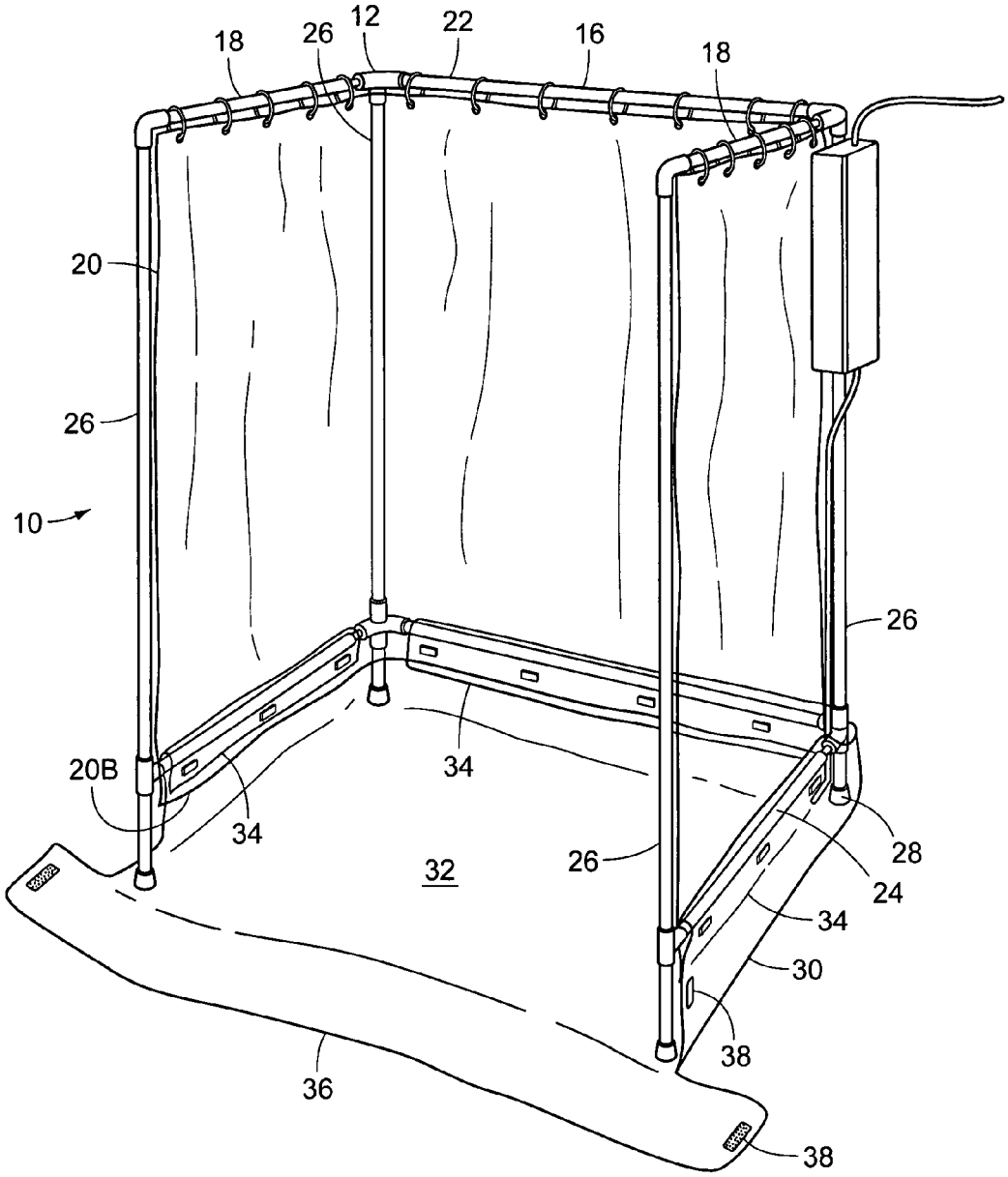
FIG. 1 is a diagrammatic perspective view, showing a portable shower according to the present invention, per se, wherein folding mechanisms are not shown to maintain clarity.

FIG. 1 illustrates a portable shower stall 10 in a fully deployed position. The shower stall includes a frame 12 which conceptually defines a pair of side panels 18, and a rear panel 16 therebetwen. A curtain 20 substantially and continuously spans one of the side panels 18, the rear panel rear panel 16, and other of side panels 18 to prevent water from leaving the shower stall 10. In particular, the stall has a top rail 22 from which the curtain 20 hangs and drapes downwardly therefrom. When in the deployed position shown, the side walls 18 extend substantially perpendicularly to the rear wall 16.

A base tray 30 extends beneath the frame 12 to catch water. The base tray 30 is made of a flexible plastic material. In particular, the frame 12 has a lower rail 24 that extend substantially parallel to the top rail 22 and facilitates attachment of the base tray 30. The panels 16, 18 are partially defined by four vertical posts 26 that extend between the top rail 22 and lower rail 24, and further extend downwardly below the lower rail 24. Feet 28 are located on each of the posts 26 beneath the lower rail 24. The feet 28 all rest within the base tray 30. Accordingly, the base tray 30 even captures water that travels down the vertical posts 26. Further, the curtain 20 has a bottom edge 20B that hangs in front of the front of the posts 26 and within the base tray 30, inwardly of both the lower rail 24. Note that "inwardly" as used herein refers to toward within the space created by the side panels 18 and rear panel 16 of the frame 12.

Figure 2:
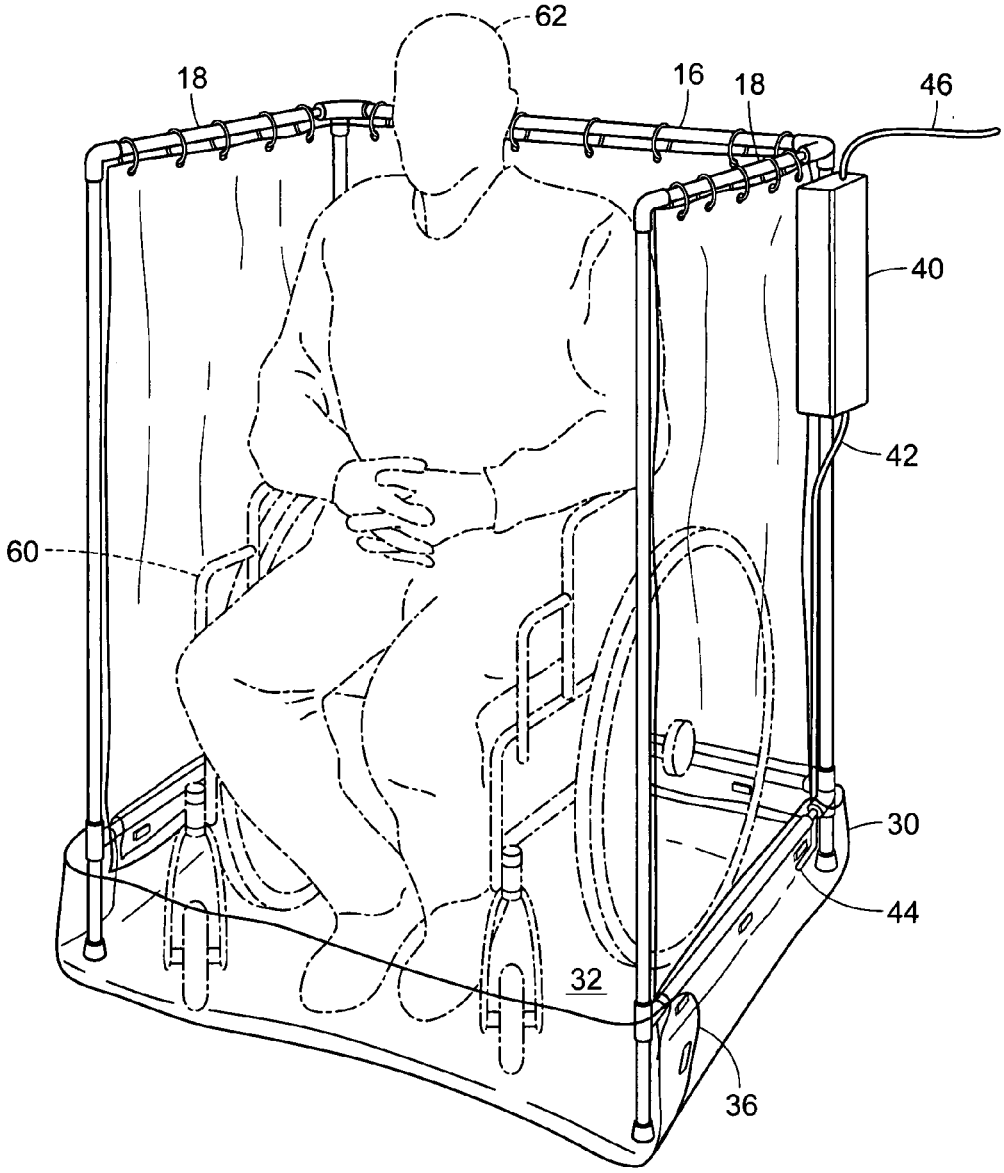
FIG. 2 is a diagrammatic perspective view, similar to FIG. 1, except wherein a person seated in a wheelchair has wheeled himself into the shower stall.

The base tray 30 has a bottom surface 32, three frame engaging flaps 34 extending upwardly from the bottom surface 32, and a front flap 36. The frame engaging flaps 34 each selectively extend over the lower rail 24 and fasten to itself to secure the base tray 30 to the frame 12 at the side panels 18 and rear panel 16. The front flap 36, however, selectively attaches to adjacent frame engaging flaps 34 to complete the base tray 30 as capable of retaining water, or selectively detaches from the adjacent frame engaging flaps 34 to fold downwardly to be substantially coplanar with the bottom surface 32, to "floor level", to allow a wheelchair 60 to roll over the front flap 36 and onto the bottom surface 32, as seen in FIG. 2. Accordingly, a wheelchair occupant 62 is thereby positioned between the side walls 18 and rear wall 16 for bathing. Also seen in FIG. 2, the front flap 36 has been raised and fastened to frame engaging flaps 34 using hook and loop fastener material 38 to allow bathing to begin. It should be considered, however, that other fasteners—such as snaps—may also be used.

To facilitate removal of water from the base tray 30, a pump 40 is attached to the frame 12. The pump 40 contains a includes an inlet tube 42 having an inlet end 44, and an outlet tube 46. The inlet end 44 is positioned within the base tray 30 near the bottom surface 32. Accordingly, when the base tray 30 begins to fill with water, the pump evacuates water therefrom.

Figure 3:
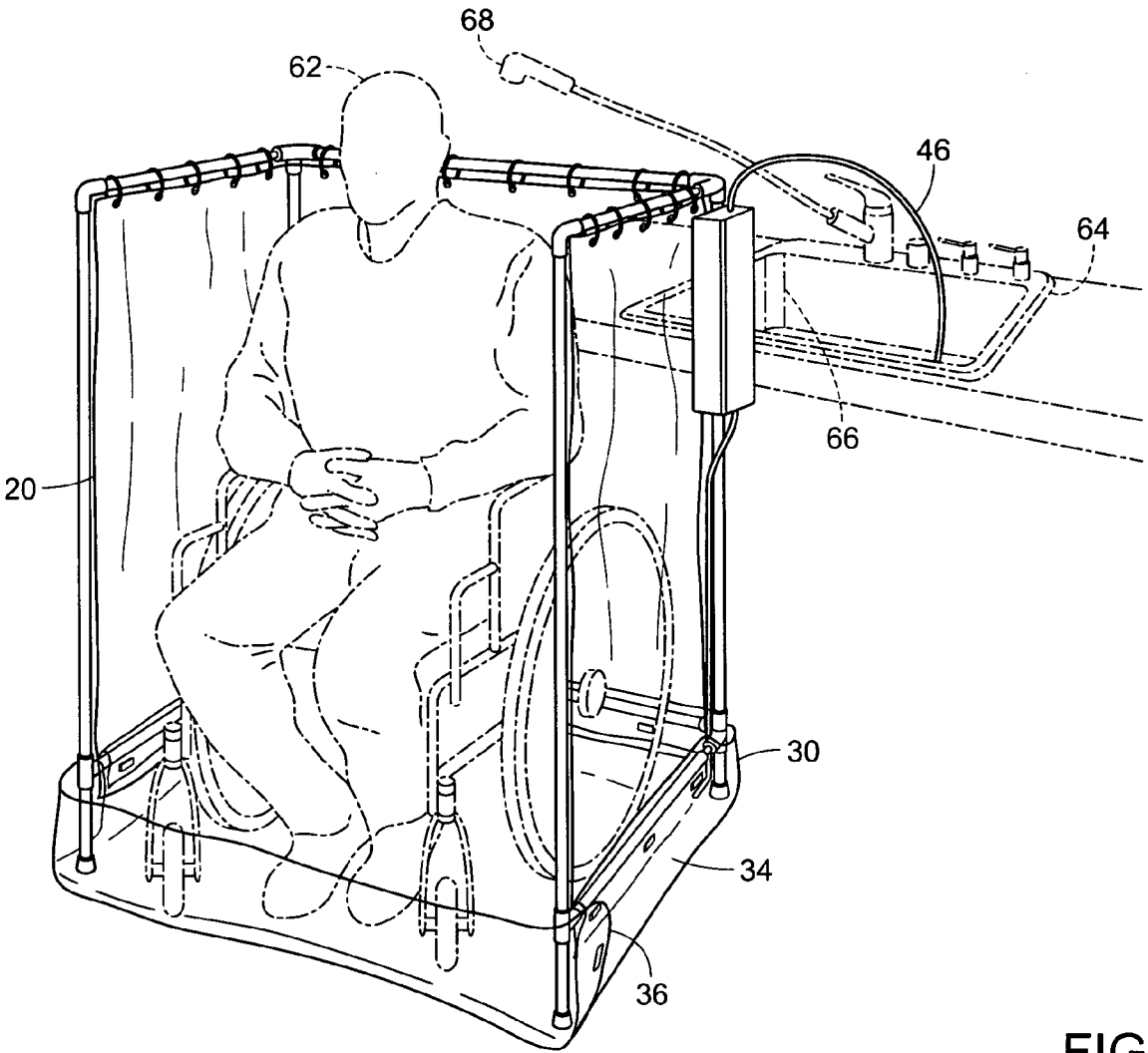
FIG. 3 is a diagrammatic perspective view, similar to FIG. 3, except wherein the person seated in the wheelchair can shower using the hand sprayer from a kitchen sink, and wherein waste water is returned to the drain of the kitchen sink by the present invention.

FIG. 3 shows the portable shower stall 10 having been set-up in a kitchen in proximity to a kitchen sink 64. The sink has a basin 66 and a hand sprayer 68. The hand sprayer is used to bathe the wheelchair occupant 62, while the outlet tube 46 is placed within the basin 66 so that the pump 40 can remove water from the base tray 30. Thus, as the wheelchair occupant 62 is bathed with the hand sprayer 68 waste water is deflected into the base tray 30 by the curtain 20. The water enters the inlet tube 42 and is returned to the basin 66 by the pump 40.

Figure 4:
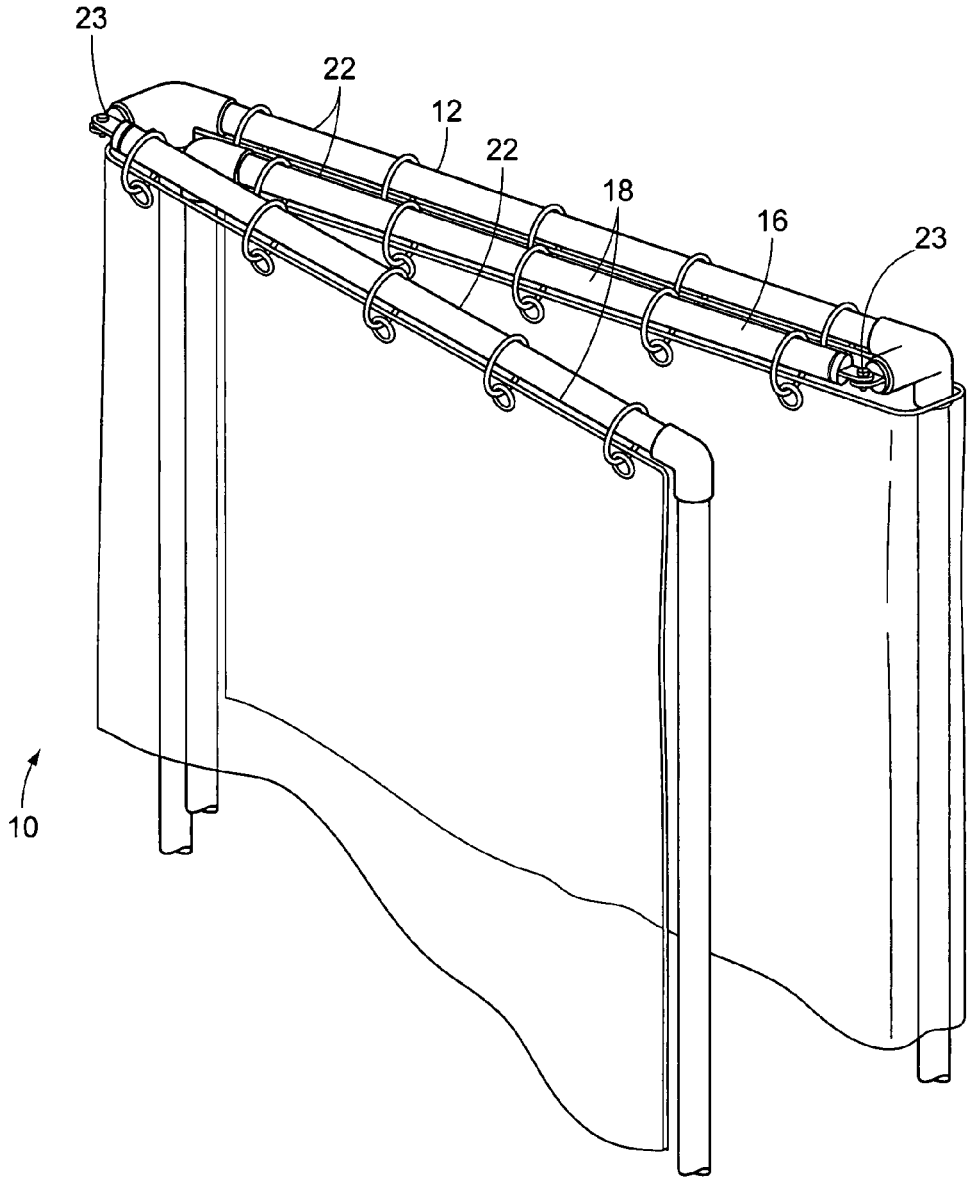
FIG. 4 is a diagrammatic perspective view, illustrating how the stall is folded for storage.

FIG. 4 illustrates how the shower stall 10 is folded for storage. Once the basin has been at least partially detached from the frame 10 by detaching the frame engaging flaps 34 at least from the side panels 18 and rolling up the base tray 30, the frame 12 is folded for storage. In particular, the top rail 22 (and the lower rail 24) has folding joints 23 which allow the side panels 18 to be folded to extend substantially parallel to the rear panel 16 as illustrated.

In conclusion, herein is presented a portable shower stall that allows a person to bathe while seated in a wheelchair. The invention is illustrated by example in the drawing figures, and throughout the written description. It should be understood that numerous variations are possible, while adhering to the inventive concept. Such variations are contemplated as being a part of the present invention.

What is claimed is:

1. A portable shower stall, for allowing a person seated in a wheelchair to bathe within a kitchen having a sink having a basin and a hand sprayer, comprising:

a frame having a pair of side panels and a rear panel, the side panels selectively folding to extend nearly parallel to the rear panel and selectively deploying to extend substantially perpendicular to the rear panel, the frame having a top rail and a lower rail;

a curtain having a bottom edge, the curtain attached to the top rail and hanging downwardly therefrom such that the bottom edge extends below and inwardly the lower rail, the curtain continuously spanning one of the side panels, across the rear panel, and across the other of the side panels;

a base tray, having a bottom surface extending fully beneath the tray, frame engaging flaps that engage the lower rail, and a front flap that selectively lowers to allow the wheelchair to roll onto the bottom surface and between the side panels, rear panel and front flap, such that the front flap is subsequently raised to allow the base tray to capture water during bathing.

2. The portable shower stall as recited in claim 1, further comprising a pump secured to the frame, the pump having an inlet tube having an inlet end that is positioned within the base tray adjacent to the bottom surface, and an outlet tube that is positionable within the sink basin so that the pump can evacuate water from the base tray and into the basin.

3. The portable shower stall as recited in claim 2, wherein the frame further has vertical supports that extend downwardly from the top rail to the lower rail, and have feet that extend past the lower rail, the feet rest inside the base tray upon the bottom surface when the shower stall is deployed.

4. The portable shower stall as recited in claim 3, wherein the each of the frame engaging flaps selectively extends over the lower rail and fastener to itself; and wherein the front flap selectively secures to the frame engaging flaps.

5. The portable shower stall as recited in claim 4, wherein the top rail has folding joints that allow the side panels to fold substantially parallel to the rear panel.

* * * * *